United States Patent [19]

Itakura

[11] 4,444,706

[45] Apr. 24, 1984

[54] METHOD OF FORMING BALL CORE

[75] Inventor: Jinryo Itakura, Oamishirasato, Japan

[73] Assignee: Yugen Gaisha Itakura Ball, Chiba, Japan

[21] Appl. No.: 396,745

[22] Filed: Jul. 9, 1982

[51] Int. Cl.[3] ..... B28B 1/08

[52] U.S. Cl. ..... 264/71; 264/342 R

[58] Field of Search ..... 264/71, 342 R

[56] References Cited

U.S. PATENT DOCUMENTS

| | | | |
|---|---|---|---|
| 3,254,979 | 6/1967 | Knapp et al. | 264/71 |
| 4,105,729 | 8/1978 | Helmrich et al. | 264/71 |
| 4,408,807 | 10/1983 | Singer | 264/71 |

*Primary Examiner*—James R. Hall

*Attorney, Agent, or Firm*—Edward F. Levy

[57] ABSTRACT

Wool fiber is moistened and compressed, and the moistened wool fiber is heated in a metallic mold. Said wool fiber is intertwined in the mold and forms a core of a ball.

1 Claim, 4 Drawing Figures

METHOD OF FORMING BALL CORE

BACKGROUND OF THE INVENTION

This invention relates to a method of forming the core of a ball.

The conventional method of forming the core of a ball is disadvantageous in that the core loses its shape when it is taken out of the metallic mold because of the fact that the fibers are merely fixed by compression. Accordingly, the operation of fastening a thread to the core is difficult. Moreover, another disadvantage is that the core having the fastened thread cannot be formed into a perfectly round ball.

SUMMARY OF THE INVENTION

The present invention has been proposed to solve the afore-mentioned problems, and its main object is to carry out shape retention and forming at the same time.

A further object of the present invention is to improve the shape-retaining property of the core following the formation thereof; thereby facilitating the thread fastening operation.

A still further object of the present invention is to provide a method of forming the core of a ball which has a perfectly round shape.

Further objects and features of this invention will be apparent from the following detailed description taken in conjunction with the accompanying drawings in which like reference characters designate the same or similar parts throughout the figures thereof.

DESCRIPTION OF THE PREFERRED EMBODIMENT

Figure 1:
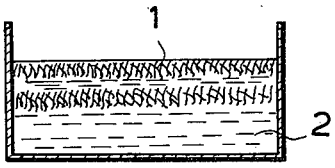
FIG. 1 is a cross-sectional view of wool soaked in an alkaline solution.

Wool is immersed in an alkaline solution comprising 0.1 percent by weight of soda carbonate and 0.0005 percent by weight of caustic soda. In FIG. 1, wool is indicated at reference number 1, and the alkaline solution at numeral 2. An alternative to immersing the wool in the alkaline solution 2 is to spray the wool with the alkaline solution.

Figure 2:
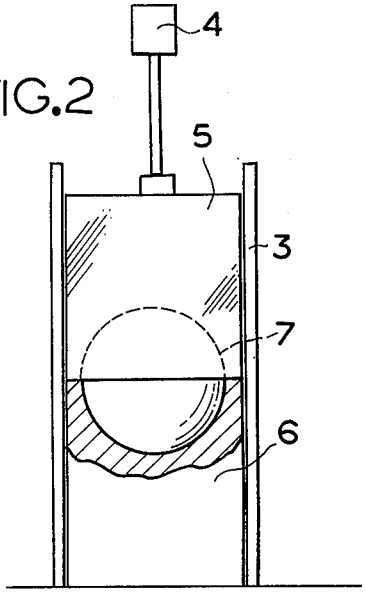
FIG. 2 is a general view of the apparatus for forming the core.

The core 7 of a ball is formed by packing a guide tube 3 with the wool 1 treated as described above, and by forcibly pressing a half mold 5 forcibly against another half mold 6 by means of a cylinder 4 which vibrates as it descends. (FIG. 2)

Figure 3:
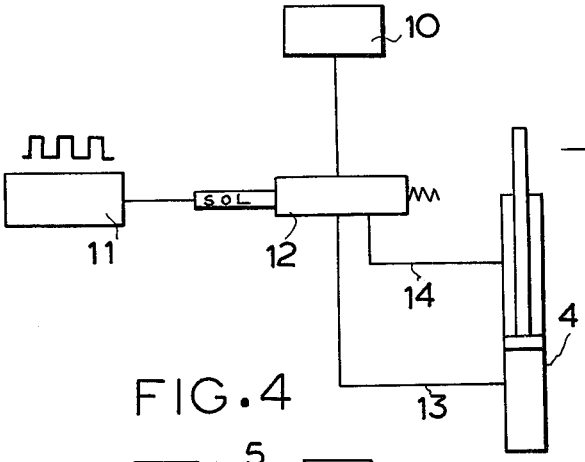
FIG. 3 is a block diagram of the vibrating means.
Figure 4:
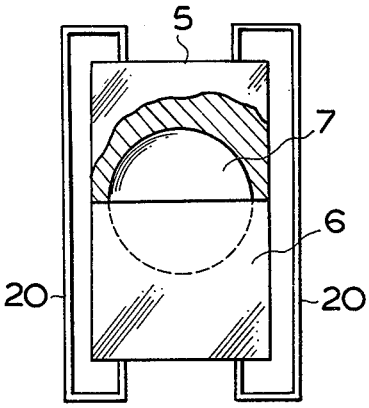
FIG. 4 is a general view of the keyed mold.

The cylinder 4, as shown in FIG. 3, adds an intertwining action to the compressing motion by vibrating means. This motion is achieved by actuating a pressure supply 10, and at the same time by supplying the cylinder 4 with compressed air alternately through lines 13 and 14 when a signal generator 11 delivers a signal to the solenoid of a switch valve 12. As a result, the core 7 is subjected to a mechanical action owing to the motion of the cylinder 4 as it repeatedly pushes against and separates from the mold 5.

The molds 5 and 6 formed in this way are heated to temperature of from 100° C. to 120° C. for a period from 20 to 25 minutes while they are maintained in the joined condition by keys 20, 20. The result is that shrinking of the wool 1 is further hastened and that the wool 1 changes into felt having a spherical shape. More particularly, the wool fiber is considered to turn into felt due to shrinkage when it is soaked in water (especially an alkaline aqueous solution) and heated, and because of intertwining owing to the crimping property of the wool fiber. The wool fiber therefore keeps its spherical shape even after taking the core out of the mold. Therefore, the operation of fastening the thread to the core and of covering the core with rubber can be easily carried out.

In the above description, the wool is soaked in the alkaline solution, but a neutral aqueous solution may be employed instead. Though the above description relates to an example where the ball 7 is formed integrally, this is not a strict requirement. Two cores may be joined with a rubber adhesives after each has been formed in the shape of a hemisphere.

As many apparently widely different embodiments of this invention may be made without departing from the spirit and scope thereof, it is to be understood that the invention is not limited to the specific embodiments thereof except as defined in the appended claims.

What I claim is:

1. A method of forming the core of a ball, comprising:

(a) soaking a mass of wool fiber with an aqueous solution, (b) packing said wet wool through a guide tube into a lower concave mold half having a hemispherical cavity therein, (c) moving downwardly an upper mold half having an opposed hemispherical mating cavity therein to compress said wool between said mold halves, wherein said mold halves are heated to a temperature of 100°/200° C., (d) subjecting said upper mold half to a controlled vibration during the downward movement thereof to cause intertwining of said wool fiber, (e) maintaining said wool within said heated mold halves for 20–25 minutes to shrink and form said wool mass into a spherical shape within the spherical cavity of the closed mold halves, and (f) opening said mold halves and removing said formed ball core.

* * * * *